US006249998B1

(12) United States Patent
NakaMats

(10) Patent No.: US 6,249,998 B1
(45) Date of Patent: Jun. 26, 2001

(54) MOVING VIRTUAL DISPLAY APPARATUS

(76) Inventor: Yoshiro NakaMats, 1105-10-1 Minami-Aoyama 5-chome, Minato-ku, Tokyo 107 (JP)

( * ) Notice: Subject to any disclaimer, the term of this patent is extended or adjusted under 35 U.S.C. 154(b) by 0 days.

(21) Appl. No.: 08/226,520

(22) Filed: Apr. 12, 1994

(30) Foreign Application Priority Data

Apr. 12, 1993 (JP) ..... 5-118907

(51) Int. Cl.[7] ..... G09G 3/20
(52) U.S. Cl. ..... 40/452; 345/31
(58) Field of Search ..... 40/452, 442, 431, 40/463; 362/811, 249, 251, 800, 817; 345/31

(56) References Cited

U.S. PATENT DOCUMENTS 4,470,044 * 9/1984 Bell ..... 345/31
5,057,827 * 10/1991 Nobile et al. ..... 345/31
5,202,675 * 4/1993 Tokimoto et al. ..... 345/31

FOREIGN PATENT DOCUMENTS

546844 * 6/1993 (EP) ..... 345/31
2061693 * 3/1990 (JP) ..... 40/542
336589 * 2/1991 (JP) ..... 345/31
6242732 * 9/1994 (JP) ..... 40/542

* cited by examiner

*Primary Examiner*—Cassandra H. Davis
(74) *Attorney, Agent, or Firm*—Jordan and Hamburg LLP

(57) ABSTRACT

A two-dimensional display provides a virtual image of characters and figures that is produced by moving a body equipped with luminous devices and controlling the flashing position and time of each luminous device while moving the body.

19 Claims, 6 Drawing Sheets

MOVING VIRTUAL DISPLAY APPARATUS

This invention relates to a display apparatus that is small in size, inexpensive, and moreover provides a display large in area and high in conspicuousness.

BACKGROUND OF THE INVENTION

Conventional display apparatus, such as a neon sign tower, have drawbacks such as: (1) requiring a larger area than the characters and figures to be displayed, (2) difficulties in carrying and transporting the apparatus, (3) high lighting expense such as for electricity and (4) high cost of the apparatus.

Furthermore, signals and barriers used for construction and police work only perform a lighting function and cannot produce characters and figures in two-dimensional space.

As the size of an image display becomes larger, the size and weight of the signal apparatus increases, which means an increase in manufacturing cost and maintenance expense.

SUMMARY OF THE INVENTION

Applicant's invention provides a two-dimensional display that provides a virtual image of characters and figures produced by moving a body equipped with luminous devices and controlling the flashing position and time of each luminous device while the body moves.

DESCRIPTION OF THE PREFERRED EMBODIMENTS

Figure 1A:
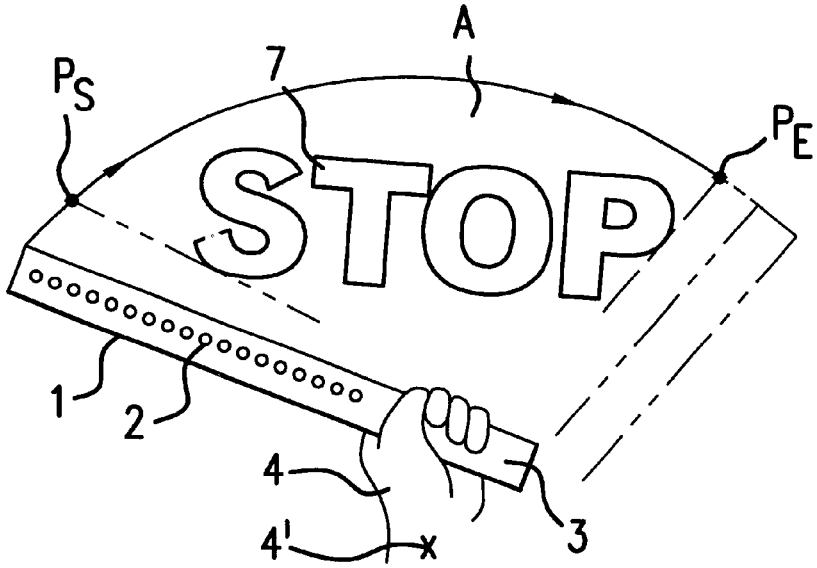
FIG. 1*a* is a front view of Embodiment 1 of the present invention.
Figure 1B:
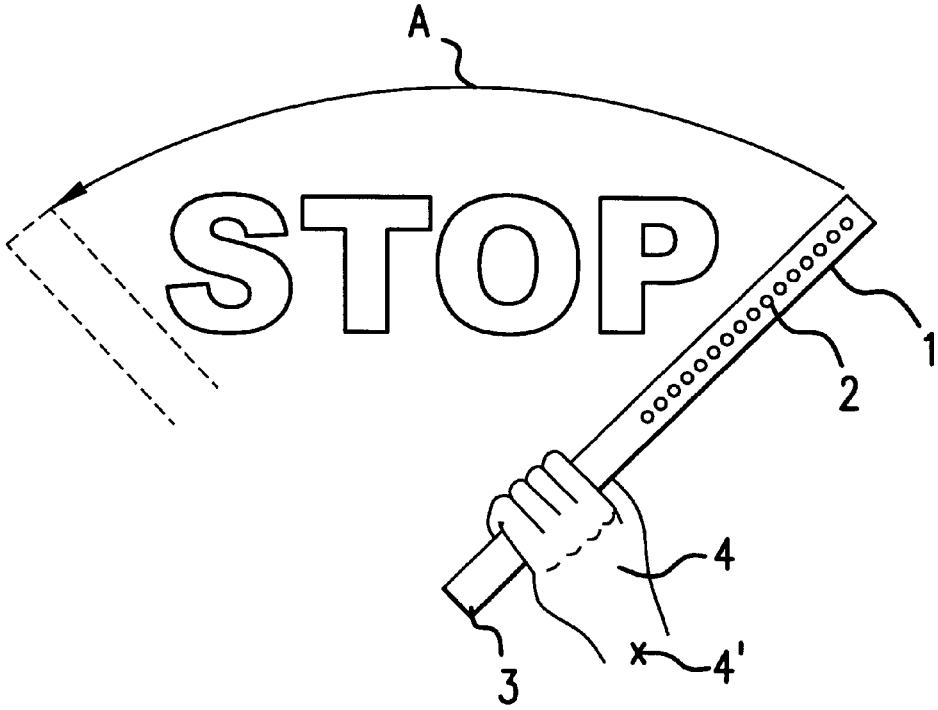
FIG. 1*b* is a rear view of the embodiment of the present invention shown in FIG. 1*a*.
Figure 2:
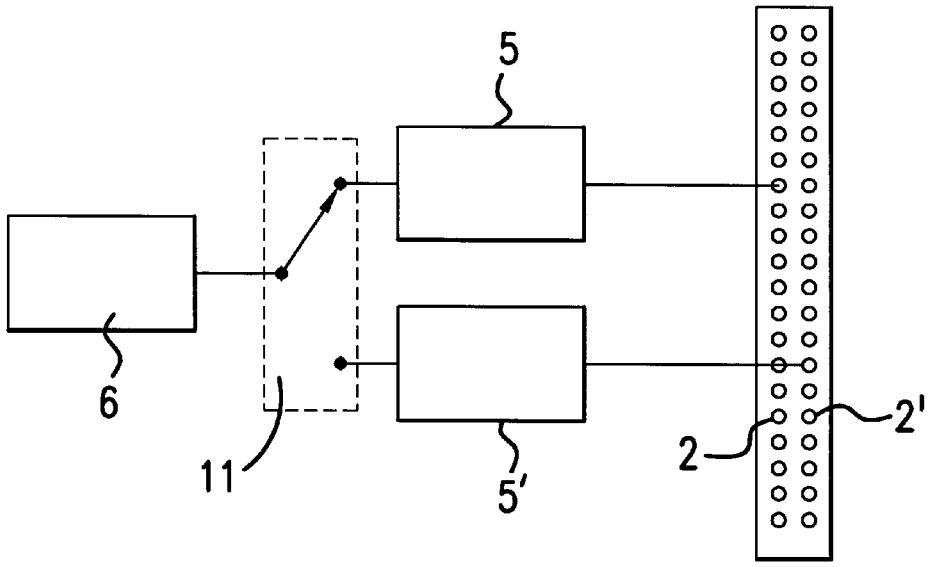
FIG. 2 is a circuit diagram of the invention.

FIGS. 1*a* and 1*b* are front and back views of Embodiment 1 of the present invention. A plurality of luminous devices 2, such as Light Emitting Diodes or Vacuum Fluorescent Displays, are mounted on a body which is in the shape of a bar 1. In FIG. 1, the luminous devices 2 are arranged in one line, however, the luminous devices 2 can be arranged in a plurality of lines as well as on both sides of the bar 1. A handle 3 on the bar 1 is held by a person's hand 4. Electric circuits 5 and 5' control lighting of the plurality of luminous devices 2 and a battery 6 is contained in the handle 3 as shown in FIG. 2. A switch 11 is operable to switch the circuits 5 and 5'.

Figure 3:
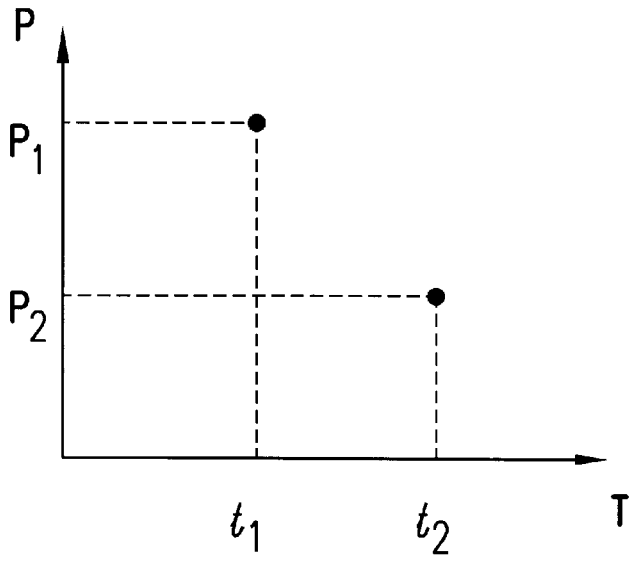
FIG. 3 is a drawing showing the relationship between the flashing position and time.

Electric circuits 5 and 5' provide electrical wiring and control for the plurality of luminous devices 2 so that the luminous devices 2 are switched on and off according to time T and the lighting position P of the luminous devices 2. For example, one luminous device 2 at position $P_1$ would light at time $t_1$ and another luminous device 2 at position $P_2$ would light at time $t_2$ as shown in FIG. 3.

Figure 4:
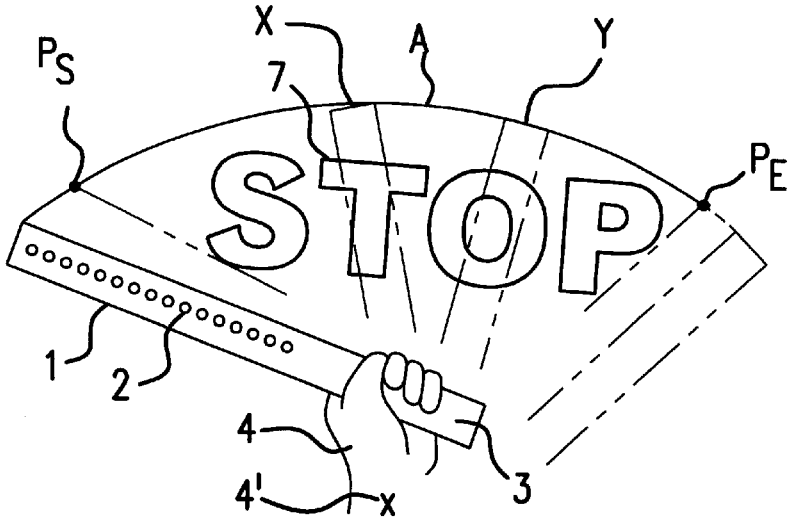
FIG. 4 is another front view of Embodiment 1 of the present invention.

The bar 1 is swung from the solid line position to the broken line position, as shown in FIG. 1, by a person whose hand 4 grasps the handle 3 of the bar 1 and swings the bar 1 such that the bar 1 pivots around the axis of rotation 4' which corresponds to the wrist of the person swinging the bar 1. As the bar 1 is swung from the position $P_S$ at a lower level to position $P_E$ as shown in FIG. 1, the lapse of the flashing lights of the LED's produce an image of the characters 7, expanded in size. The after image of the eye senses the image of the characters 7 which appear consecutively in a two-dimensional space formed by the angle of swing which equals the elapsed time T. Thus, $P_S$ is the position where the display characters start and $P_E$ is the position where the display of character ends. Intermediate positions are shown at X and Y in FIG. 4.

FIG. 1 shows an embodiment for controlling the display of characters and figures by the clock of circuit 5 regardless of the swinging speed, but it is possible to detect the angle of the bar 1 by a hanging weight or by a gyro such that the weight or gyro remain unchanged in position even if body moves as shown in FIG. 1.

Figure 5:
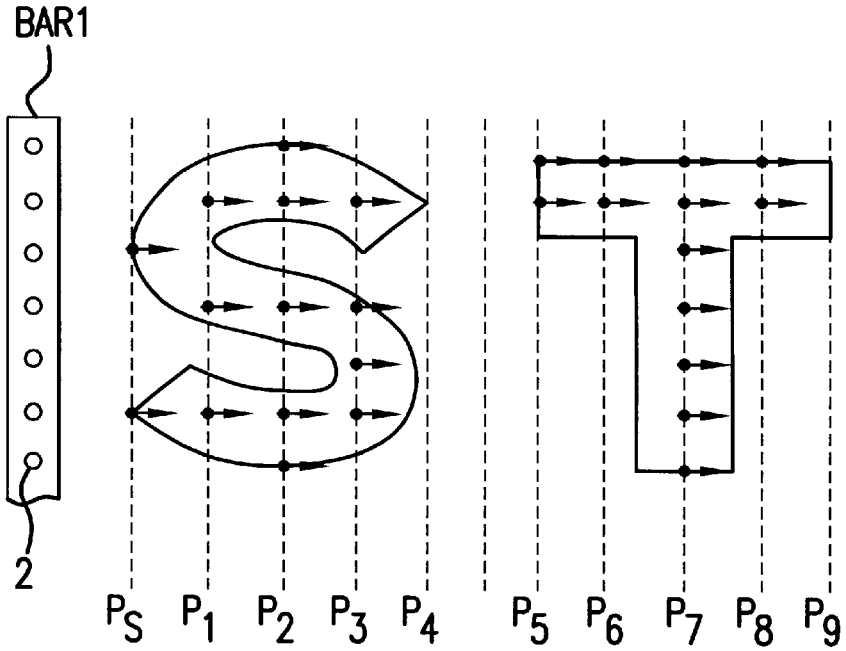
FIG. 5 is a partial front view of Embodiment 1 of the present invention.

As the position of the bar 1 changes in moving from $P_S$, $P_1 \ldots P_9$, $P_E$ as shown in FIG. 5 by swinging the bar 1 in the direction from $P_S$ to $P_E$ as shown in the drawings, many of the luminous devices 2 are lit up as indicated by the black dots along with the letter "S" in FIG. 5 at each position of $P_S$ through $P_E$ by operation of the electric circuits 5, 5' to control which of the various luminous devices 2 are to be lit up.

As the bar 1 moves from $P_S$, $P_1$, $P_2$, $P_3$, $P_4 \ldots P_E$, the luminous devices 2 are lit up changing the luminous position, but each position of $P_S$ to $P_4$ is unified to see the letter "S", because the light of the luminous devices 2 from $P_S$ to $P_4$ remains in the optic nerve of the human brain by human afterimage effect.

The time that the stimulation of light remains in the human brain by afterimage effect is 0.1 second after lighting. Therefore, if the speed of swinging the bar 1 from $P_S$ to $P_4$ is within 0.1 second, the letter "S" is visualized. The same thing can be said regarding the letters "T", "O" and "P" of the word STOP. Consequently, the swinging speed of the bar 1 is the value calculated by the formula of dividing the longitudinal width of the letter by 0.1 second.

The letters appear sequentially as S-T-O-P by swinging the bar 1 and eventually indicates STOP, and it is satisfactory if the swinging speed of bar 1 is within 0.4 second.

All parts of the electric circuits 5, 5', the battery 6, the switch 11 for STOP and GO and the electrical wire to electrically connect these parts to the luminous devices 2 are built into the bar 1.

The electric circuit 5 controls the flashing of the luminous devices 2 by the method as explained above to indicate the letters such as S, T, O, P. The luminous devices 2' are lit up by electric circuit 5'. Different letters are flashed by the electric circuits 5 and 5' and the letters can be selected by operating the switch 11.

By attaching a hanging weight or a gyro to bar 1, flashing starts when the bar 1 swings up to the upper end, and flashing stops when bar 1 swings down to the lower end. It is also possible to start or stop the flashing of the luminous devices 2, 2' at a desired time by attaching a clock to bar 1.

FIG. 6 is an embodiment of the invention wherein when holding the handle 3 by hand and swinging the bar 1 generally vertically by one's arm 4 or shoulder that establishes the center of rotation, a weight 9, hanging down from the axis 8, makes electrical contact with a contact 10 at the position $P_S$ and thereby the clock switch turns to start the lighting of the devices to thereby start the flash of the characters 7. When the bar 1 comes to the position $P_E$ weight 9 and contact point 10' touch electrically and thereby the flashing and clock switching stops to end the flashing of the characters 7. In this arrangement, the weight 9 or a gyro can be used to determine the swing angle of the bar 1 and circuit 5 controls which luminous devices 2 flash to form the characters 7 according to the swing angle.

A hanging weight and a gyro have a common characteristic in that both the hanging direction of the weight (hanging direction of weight 9 in FIG. 6) and the direction of the axis of the gyro remain unchanged, keeping a fixed direction, regardless of the position of the bar 1. The present invention can utilize both of these concepts of a hanging weight and a gyro. The gyro can be built in the bar 1 at almost the same position as the hanging weight 9 and the letters are displayed by circuit 5, making use of the gyro's fixed direction as well as in the case of the hanging weight.

When the bar 1 comes to the position $P_S$, weight 9 touches contact 10 of bar 1 to supply electricity to circuit 5 and also to operate a clock switch built in the bar 1.

Furthermore, by swinging down bar 1 in the direction toward $P_E$, circuit 5 selects luminous devices to be lit in accordance with time order ($P_S$ through $P_9$) by the clock switch and the letters are displayed. Then, when the bar 1 arrives at the position of $P_E$, the weight 9 touches contact 10' of the bar 1 to cut the electric supply to circuit 5.

Figure 6A:
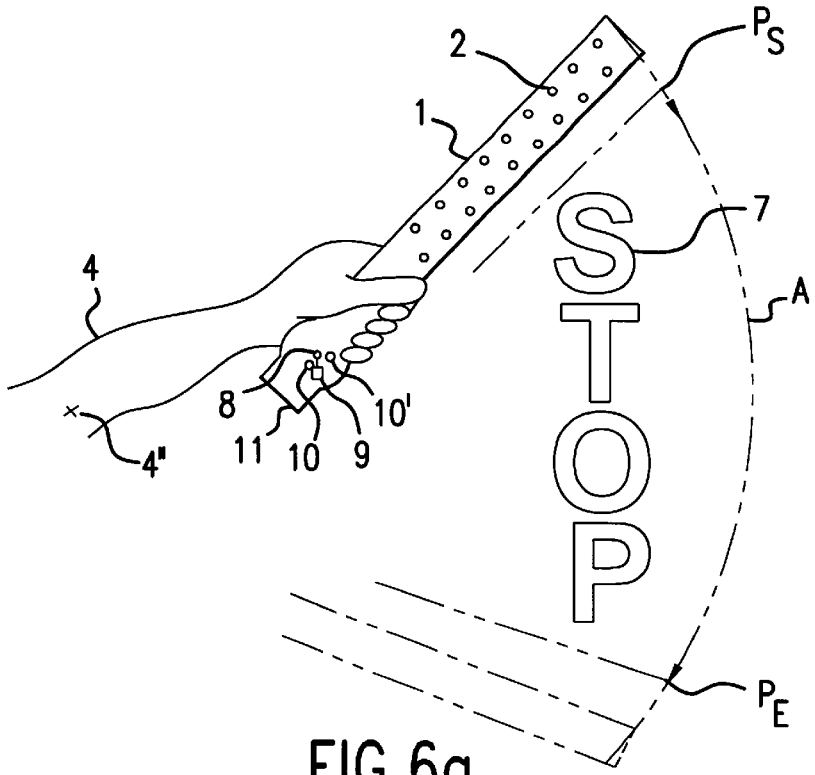
FIG. 6*a* is a front view of Embodiment 2 of the present invention.

Displaying the letters horizontally as shown in FIG. 1 or vertically as in FIG. 6*a* can be done by changing the position of contacts 10 and 10' of bar 1.

Figure 6B:
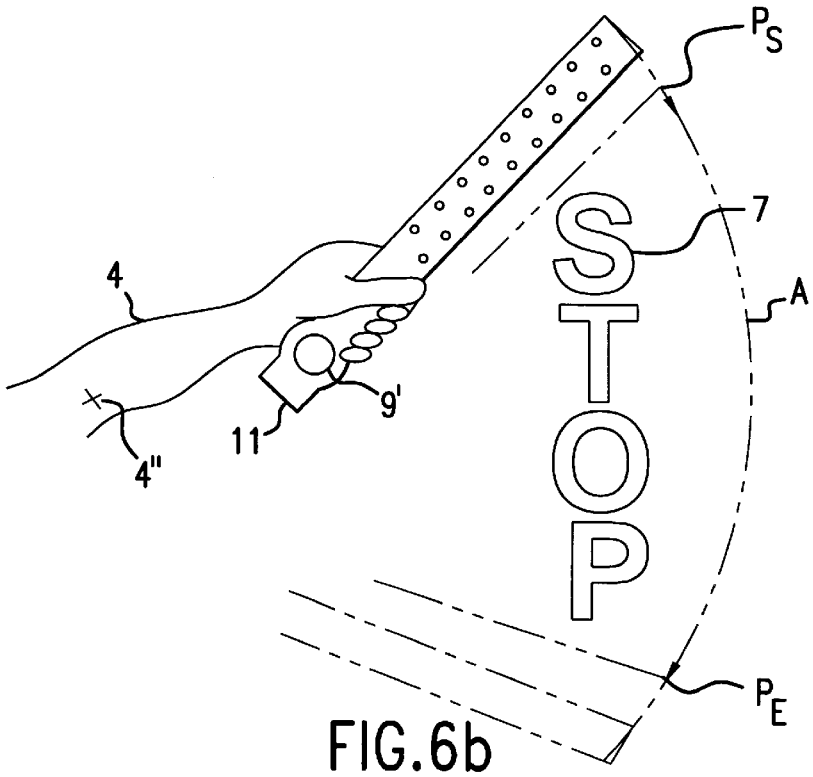
FIG. 6*b* is an alternative configuration of Embodiment 2 shown in FIG. 6*a*.

As an alternative method to take the place of the clock switch, it is also possible to detect through sensors the swinging changing angle of the bar 1 in a first direction and position of the weight 9 or a gyro 9, as shown in FIG. 6*b* , and to display letters by controlling the flashing of the luminous devices in compliance with the ever changing angle through circuit 5.

As shown in FIG. 2, two circuits 5 and 5' are provided and circuit 5 is to display the character of STOP and circuit 5' is to display GO. Red LED's 2 and green LED's 2' are arranged on the bar 1 to display a red color for STOP and a green color for GO, respectively, by circuits 5 and 5'.

Figure 7:
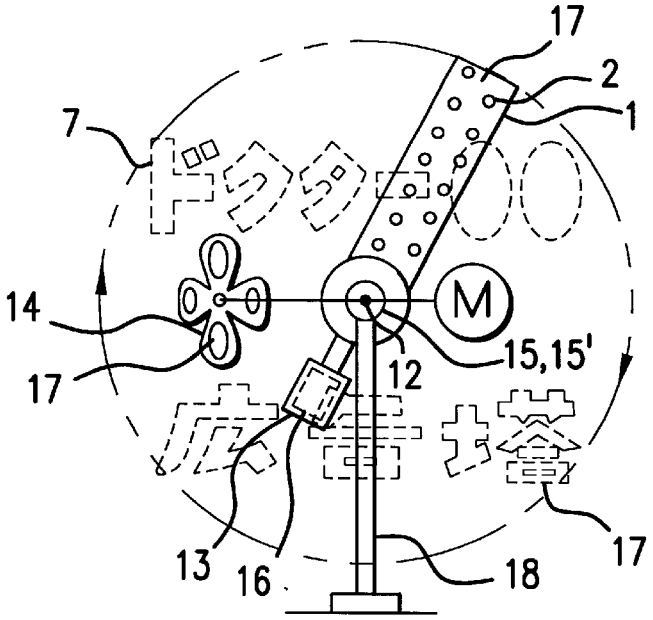
FIG. 7 is a front view of Embodiment 3 of the present invention.

FIG. 7 shows an embodiment of the invention wherein the bar 1 with luminous devices 2 is pivotal about axis 12 to freely rotate. A dynamic balance weight 13 is provided on the opposite side of bar 1 which is provided with the luminous devices 2. The bar 1 is rotated by motor M or windmill 14 to display characters 7 such as "Dr.", "Advertising Tower", etc. A servo-motor which is operable to detect angle and position is provided. Slip ring 15 and contact shoe 15' provide for determining the rotating angle of bar 1, and the luminous devices 2 light up according to its position to display the characters 7. It is possible to change the flashing position of the luminous devices by uniform rotation of the bar 1 and this can be achieved by a governor and also by a clock instead of interlocking with the rotating angle.

A windmill 14 may be used instead of the motor M as shown in FIG. 7. This makes use of the wind available, for example, when the invention is used for an advertising tower or on the roof of a building. In this application, a storage battery 16 may be used for the weight 13. The storage battery 16 can be used both as a power supply and as a weight. Consequently, the supply of electricity from the outside is not required, resulting in eliminating the need for a slip-ring for the supply of outside electricity, thereby providing a dual advantage.

A solar battery 17 may be used on the entire surface of bar 1 with its luminous devices 2 to light the luminous devices 2 and also to the entire surface of the windmill 14 to charge the storage battery 16. This provides not only for the rotation of the windmill 14, but also results in no need to provide an outside power supply. Additionally, since support 18 is simple in construction, it can be small in area, which means that it can be very light weight and the bar 1 can be placed on a roof not withstanding its heavy weight.

Figure 8:
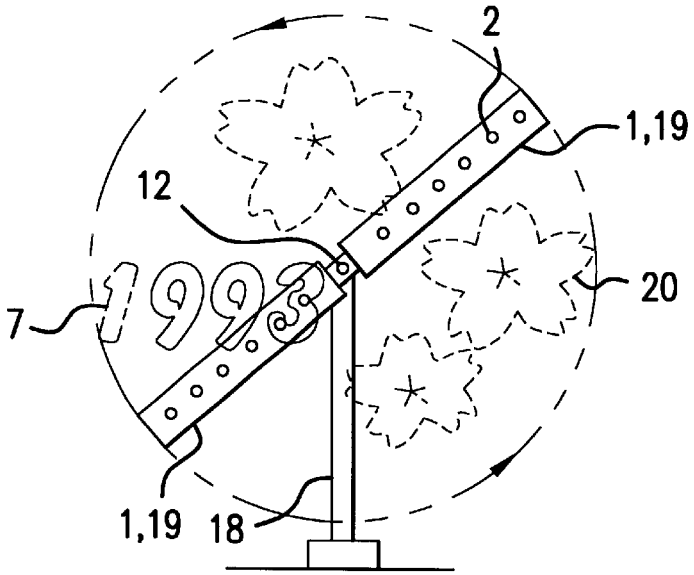
FIG. 8 is a front view of Embodiment 4 of the present invention.

FIG. 8 shows another embodiment of this invention wherein the windmill 14, shown in FIG. 7, is not required because the bar 1 itself is twisted or inclined like a propeller or windmill. In addition to arranging two parts of body 1 with luminous devices on both right and left sides of a central axis 12, a solar battery 17 can be used for the luminous devices 2 on the surface 19 of body 1, and characters 7 and FIGS. 20 can be produced without an outside power supply. Windmill 14 and motor M are not required as for the embodiment of FIG. 7.

Figure 9:
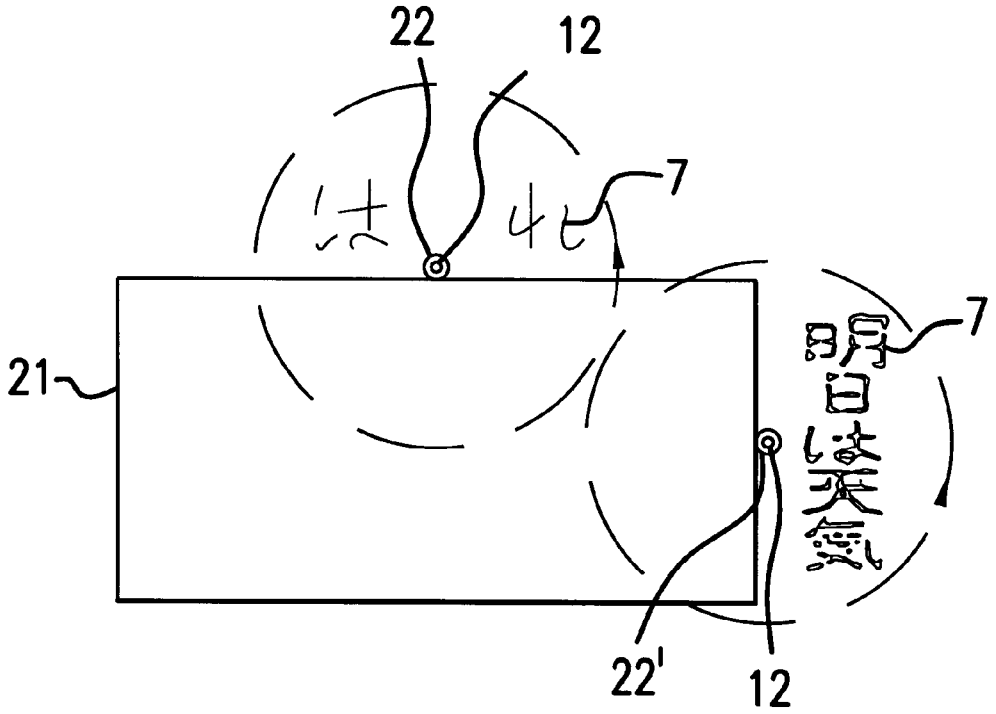
FIG. 9 is a front view of Embodiment 5 of the present invention.

FIG. 9 shows another embodiment of the invention wherein the apparatus is applied to an already built advertising tower 21 by using welded pipes 22 and 22' on any position of the existing advertising tower 21 and providing a rotating axis 12 at the axis of the pipes 22 and 22' to thereby rotate the bar 1 in order to obtain the display of characters 7.

Various versions such as using shapes other than a bar for supporting the luminous devices 2 may be used. The body with the luminous devices may be raised in a horizontal motion or in a rectilinear motion or curvilinear motion, etc., besides being rotated.

As this invention is an extremely small and inexpensive apparatus which can display larger images in area and size, it is portable for such convenient use as a warning light to be used by policemen and guidance equipment for traffic or construction and yet it can provided on a large sign. In case of applying this invention to an advertising tower, because of its small size, light weight and inexpensive cost, for instance 1/20 of conventional apparatus means, it can be built on a roof of a limited small area or on a location not capable of withstanding heavy weight. This is an epochmaking invention in that people standing still or walking can see a virtual two-dimensional image by a combination of movement, time, speed, and flashing position of the body.

What I claim is:

1. A display apparatus for displacement through a swing arc to produce a light display, comprising:

a support member having a plurality of spaced luminous devices disposed thereon;

said support member being movable through said swing arc;

said support member having lighting control means for selectively lighting individual respective ones of said luminous devices at predetermined discrete positions of the respective luminous devices within said swing arc as determined by detection of positions of said support member along said swing arc to create said light display along the swing arc of said support member; and said lighting control means including a self-contained position detection means disposed on said support member for deter said positions of said support member and thereby positions of the respective luminous devices by having a body displaceable relative to said support member by movement of the support member and determining said position based on displacement of said body relative said support member.

2. A display apparatus according to claim 1 further comprising means for moving said support member along a curvilinear path.

3. A display apparatus according to claim 1 further comprising means for moving said support member along a circular path.

4. A display apparatus according to claim 1 wherein said luminous devices are selected from the group consisting of Light Emitting Diodes and Vacuum Fluorescent Displays.

5. A display apparatus according to claim 1 wherein said luminous devices are arranged in a linear row.

6. A display apparatus according to claim 5 wherein said luminous devices are arranged in a plurality of linear rows.

7. A display apparatus according to claim 1 wherein said support member has an obverse side and a reverse side, said luminous devices being disposed on said obverse side and on said reverse side.

8. A display apparatus according to claim 1 wherein said support member is an elongated bar.

9. A display apparatus according to claim 1 further comprising:

said support member being an elongated bar on which said luminous devices are disposed; and rotatable support means for rotatably supporting said elongated bar for rotation about a rotation axis.

10. A display apparatus according to claim 9 wherein said rotatable support means further comprises a motor means for rotating said elongated bar about said rotation axis.

11. A display apparatus according to claim 9 wherein said rotatable support further comprises a windmill means for rotating said elongated bar about said rotation axis.

12. The display apparatus according to claim 9 further comprising:

said elongated bar being mounted about said rotation axis at a substantial midpoint of said elongated bar; and said elongated bar having first and second surfaces on opposing sides of said substantial midpoint having opposing angles of inclination to effect rotation of said elongated member in response to wind.

13. A display apparatus according to claim 9 wherein said elongated bar has an outer end which transcribes a circle when said elongated bar rotates about said rotation axis.

14. A display apparatus according to claim 13 wherein said elongated bar has a length substantially equal to the radius of said circle.

15. A display apparatus according to claim 13 wherein said elongated bar has a length substantially equal to the diameter of said circle.

16. A display apparatus according to claim 1 wherein:

said body of said self-contained detection means includes a pendulum and said pendulum is a weight depending about a rotational support on said support member and contacts on said support member arranged such that said weight contacts a first contact when the support member is in one rotational position and said weight contacts a second contact when the support member is in another rotational position; and said contacting of said first contact initiates said selective lighting of said luminous devices and said contacting of said second contact terminates said selective lighting of said luminous devices.

17. A display apparatus according to claim 16 wherein said self-contained detecting means includes a slip-ring means rotatable with said support member and contact shoes red by said weight and slidably contacting said slip-ring for determining said positions of said support member and the respective luminous devices.

18. A display apparatus according to claim 1 wherein said self-contained detection means includes said body being a gyro means for detecting said positions of said support member and the respective luminous devices.

19. A display apparatus according to claim 1 further comprising:

said support member being an elongated bar on which said luminous devices are disposed;

rotatable support means for rotatably supporting said elongated bar for rotation about a rotation axis; and said rotatable support means further including a means for rotating said elongated bar about said rotation axis.

* * * * *